US007228709B2

(12) United States Patent
Hwang et al.

(10) Patent No.: US 7,228,709 B2
(45) Date of Patent: Jun. 12, 2007

(54) UNITARY AIR CONDITIONING SYSTEM

(75) Inventors: Yoon-Jei Hwang, Seoul (KR); Chan-Ho Song, Gyeonggi-Do (KR); Won-Hee Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 180 days.

(21) Appl. No.: 11/033,162

(22) Filed: Jan. 12, 2005

(65) Prior Publication Data

US 2005/0235680 A1 Oct. 27, 2005

(30) Foreign Application Priority Data

Apr. 22, 2004 (KR) ..... 10-2004-0027944

(51) Int. Cl.
*F25B 1/10* (2006.01)

(52) U.S. Cl. ..... 62/510; 62/478; 62/507

(58) Field of Classification Search ..... 62/510, 62/238.7, 298, 478, 506, 507, 508; 165/240, 165/54

See application file for complete search history.

(56) References Cited

U.S. PATENT DOCUMENTS

| | | | | |
|---|---|---|---|---|
| 3,645,109 | A * | 2/1972 | Quick | 62/196.2 |
| 4,024,728 | A | 5/1977 | Gustafsson | |
| 5,297,396 | A | 3/1994 | Kitamoto | |
| 5,317,907 | A | 6/1994 | Shimizu et al. | |
| 5,344,069 | A | 9/1994 | Narikiyo | |
| 6,347,527 | B1 * | 2/2002 | Bailey et al. | 62/238.7 |

FOREIGN PATENT DOCUMENTS

| | | | |
|---|---|---|---|
| JP | 08014598 | A | 1/1996 |
| JP | 8-320134 | A | 12/1996 |
| JP | 2000-304301 | A | 11/2000 |

* cited by examiner

*Primary Examiner*—Melvin Jones
(74) *Attorney, Agent, or Firm*—Birch, Stewart, Kolasch & Birch, LLP

(57) ABSTRACT

A unitary air conditioning system comprises an outdoor unit including a compressor for compressing a refrigerant, an outdoor heat exchanger for heat exchange of the refrigerant and an expander connected to the outdoor heat exchanger, for expanding the refrigerant; a duct installed inside a zone of a building; a central blower unit having a heat exchanger connected to the outdoor unit through a first refrigerant pipe and a blower for supplying the air heat-exchanged by the heat exchanger to the duct; and an individual blower unit including a heat exchanger connected to the outdoor unit through a second refrigerant pipe and a fan for sending the air heat-exchanged by the heat exchanger and disposed in a zone in the building, for individually cooling or heating the zone. Accordingly, cooling or heating operation is performed on each zone of the building, and simultaneously, additional individual heating or cooling operation can be performed on a specific space, so that a cost can be reduced, and cooling or heating in the building can be efficiently performed.

9 Claims, 4 Drawing Sheets

UNITARY AIR CONDITIONING SYSTEM

BACKGROUND OF THE INVENTION

1. Field of the Invention

The present invention relates to an air conditioning system, and particularly, to an air conditioning system in which a central heating and cooling system is combined with an individual heating and cooling system.

2. Description of the Background Art

In general, a unitary air conditioning system is a kind of central heating and cooling system in which cool air or warm air is made by using a heating and cooling device provided in a factory, an office, a hotel, a house or the like, and supplied to each zone through a pipe or a duct provided in a building.

In the unitary air conditioning system, to independently supply the cool or warm air to individual zones by distinguishing a zone requiring cooling or heating and a zone which does not so, a zone controller for distributing the cool or warm air is installed on a duct, or a plurality of heating and cooling devices are individually installed correspondingly to a plurality of zones.

As shown in FIGS. 1 and 2, a conventional unitary air conditioning system includes an outdoor unit 1 fixedly installed outside a building (a two-story building in the drawing); a supply duct 3 installed inside each zone (Z1) and (Z2) in the building, for distributing the cool or warm air to the zones (Z1) and (Z2); a return duct 4 for returning the cool or warm air in each zone (Z1) and (Z2); a central blower unit 2 connected with the outdoor unit 1 by refrigerant pipes, for sending cool or warm air to the supply duct 3; and a zone controller 5 installed between the central blower unit 2 and the supply duct 3 and between the central blower unit 2 and the return duct 4, for controlling a supply and a return of the air to and from the zones (Z1) and (Z2).

The outdoor unit 1 includes a compressor 1*a* for compressing refrigerant; a first heat exchanger 1*b* connected to the compressor 1*a* by refrigerant pipes, for heat exchange between refrigerant and ambient air; an expander 1*c* for expanding volume of refrigerant and reducing pressure of refrigerant; a four way valve 1*d* disposed adjacent to the compressor 1*a*, for circulating a compressed refrigerant discharged from the compressor 1*a* according to a heating cycle or a cooling cycle; and an accumulator 1*e* disposed in the vicinity of a refrigerant inlet of the compressor 1*a*, for filtering a liquefied refrigerant.

The central blower unit 2 includes a second heat exchanger 2*a* connected to the compressor 1*a* and the expander 1*c* by refrigerant pipes, respectively; and a supply fan (not shown) disposed adjacent to the second heat exchanger 2*a*, for supplying the cool or warm air to the supply duct 3.

A plurality of discharge openings 3*a* are formed at the supply duct 3 to supply the cool or warm air to a zone requiring cooling or heating, and a plurality of suction openings 4*a* through which the air of each zone is sucked are formed at the return duct 4.

The zone controller 5 is composed of valves 5*a*, 5*b*, 5*c* and 5*d* for selectively supplying the cool or warm air to each zone (Z1) and (Z2), wherein the zone controller 5 is installed between the supply duct 3 and the return duct 4 arranged in the corresponding zone (Z1) and (Z2). By the zone controller 5, the cool or warm air is distributed thus to be supplied to each zone (Z1) and (Z2), or be selectively supplied to only one of the zones (Z1) and (Z2).

The conventional air conditioning system having such a structure is operated as follows.

First, in case that a load detected in each zone (Z1) and (Z2) is greater than a preset value, the cool or warm air is simultaneously supplied through the supply duct 3 of each zone (Z1) and (Z2). On the other side, in case that a load of just one of the zones (Z1) and (Z2) is greater than a preset value, the cool or warm air is supplied through the supply duct 3 of the corresponding zone, which requires cooling or heating, by operation of the zone controller 5.

For example, during the cooling operation, a refrigerant compressed by the compressor 1*a* of the outdoor unit 1 is condensed in the first heat exchanger 1*b* of the outdoor unit 1, and the condensed refrigerant passes through the expander 1*c* and then passes through the second heat exchanger 2*a* of the central blower unit 2, thereby exchanging its heat with the air introduced through the return duct 4. The air cooled in such a manner moves to the supply duct 3 by a supply fan (not shown).

At this time, the zone controller 5 is operated according to a load of each corresponding zone (Z1) and (Z2), thereby cooling the zone that requires cooling.

Meanwhile, during the heating operation, a flow of the refrigerant is converted by operation of the four way valve 1*d*, and a heating cycle is carried out as a reverse cycle of the cooling cycle.

However, the conventional air conditioning system constructed and operated as described above has following problems.

First, a zone controller for controlling a return and supply of air should be additionally installed when the cool or warm air is to be more intensively supplied to a zone having high loads, such as a kitchen, a sun room, an exercise room or the like in the building. However, operations for an additional installation of the duct and the zone controller are complicated.

Also, to independently correspond to a load of each zone, a plurality of outdoor units and a plurality of central blower units may be installed corresponding to the number of zones. However, it may cause an increase in cost, which is inefficient.

SUMMARY OF THE INVENTION

Therefore, an object of the present invention is to provide an air conditioning system capable of individually cooling or heating a specific zone having high loads or having no duct, by employing an individual cooling and heating system within a central cooling and heating system.

To achieve these and other advantages and in accordance with the purpose of the present invention, as embodied and broadly described herein, there is provided a unitary air conditioning system comprising an outdoor unit including a compressor for compressing a refrigerant, an outdoor heat exchanger for heat exchange of the refrigerant and an expander connected to the outdoor heat exchanger, for expanding the refrigerant; a duct installed inside a zone of a building; a central blower unit having a heat exchanger connected to the outdoor unit through a first refrigerant pipe and a blower for supplying the air heat-exchanged by the heat exchanger to the duct; and an individual blower unit including a heat exchanger connected to the outdoor unit through a second refrigerant pipe and a fan for sending the air heat-exchanged by the heat exchanger, and disposed in a zone in the building, for individually cooling or heating the zone.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
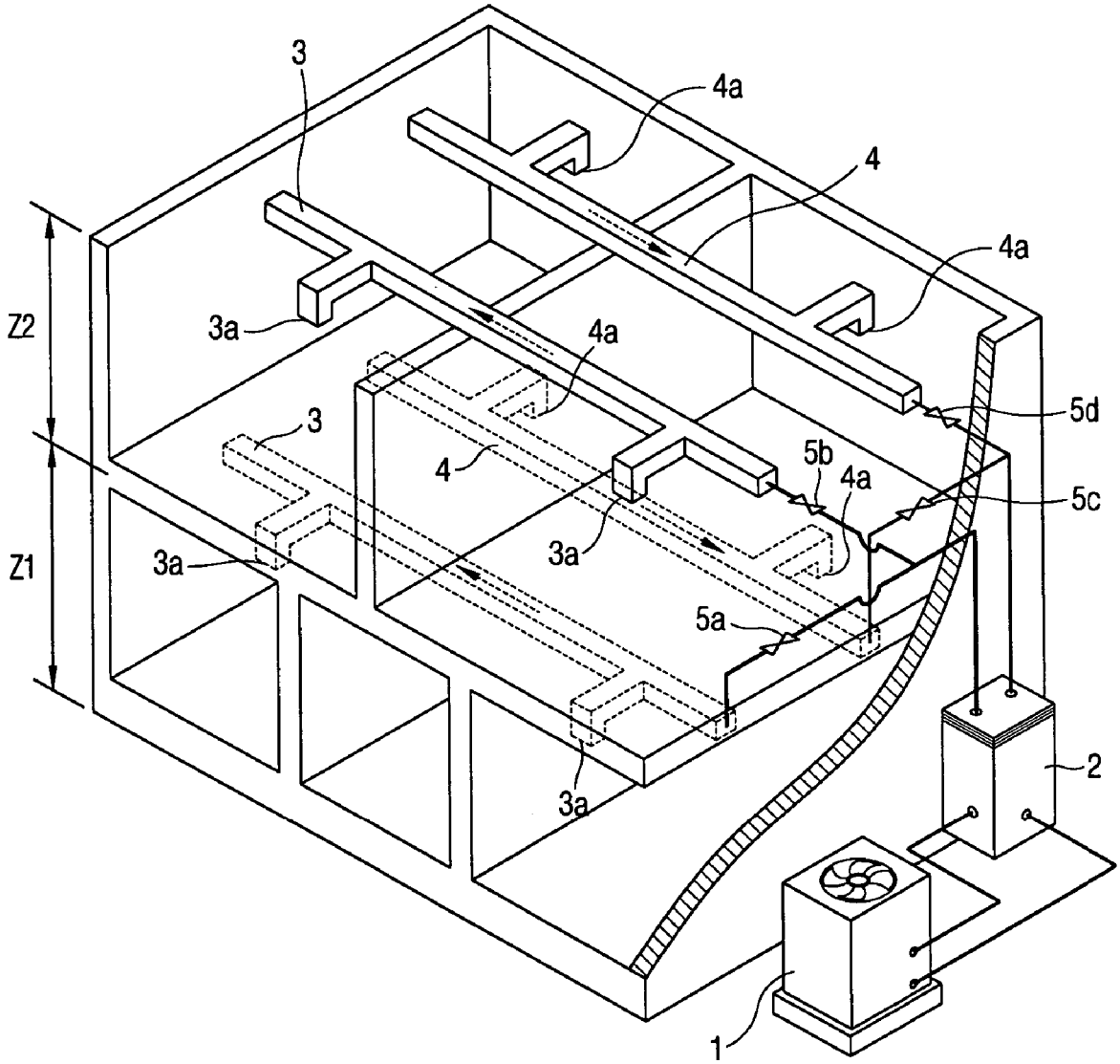
FIG. 1 CONVENTIONAL ART
FIG. 1 is a schematic view showing one example of a conventional air conditioning system.
Figure 2:
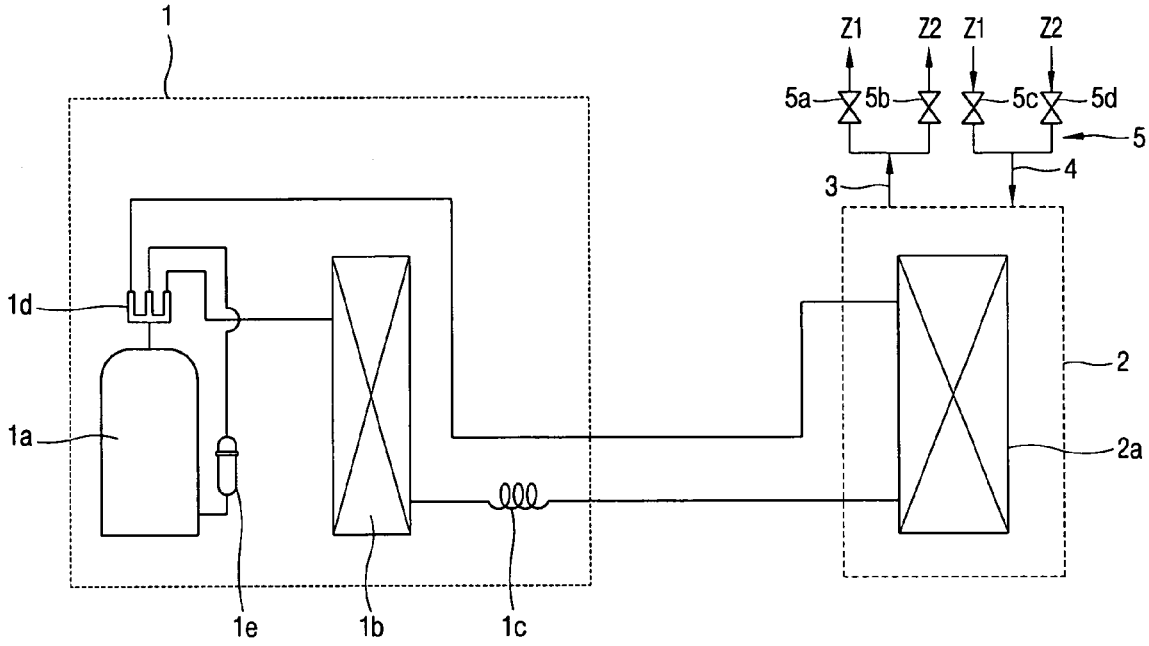
FIG. 2 CONVENTIONAL ART
FIG. 2 is a block diagram showing the air conditioning system of FIG. 1.
Figure 3:
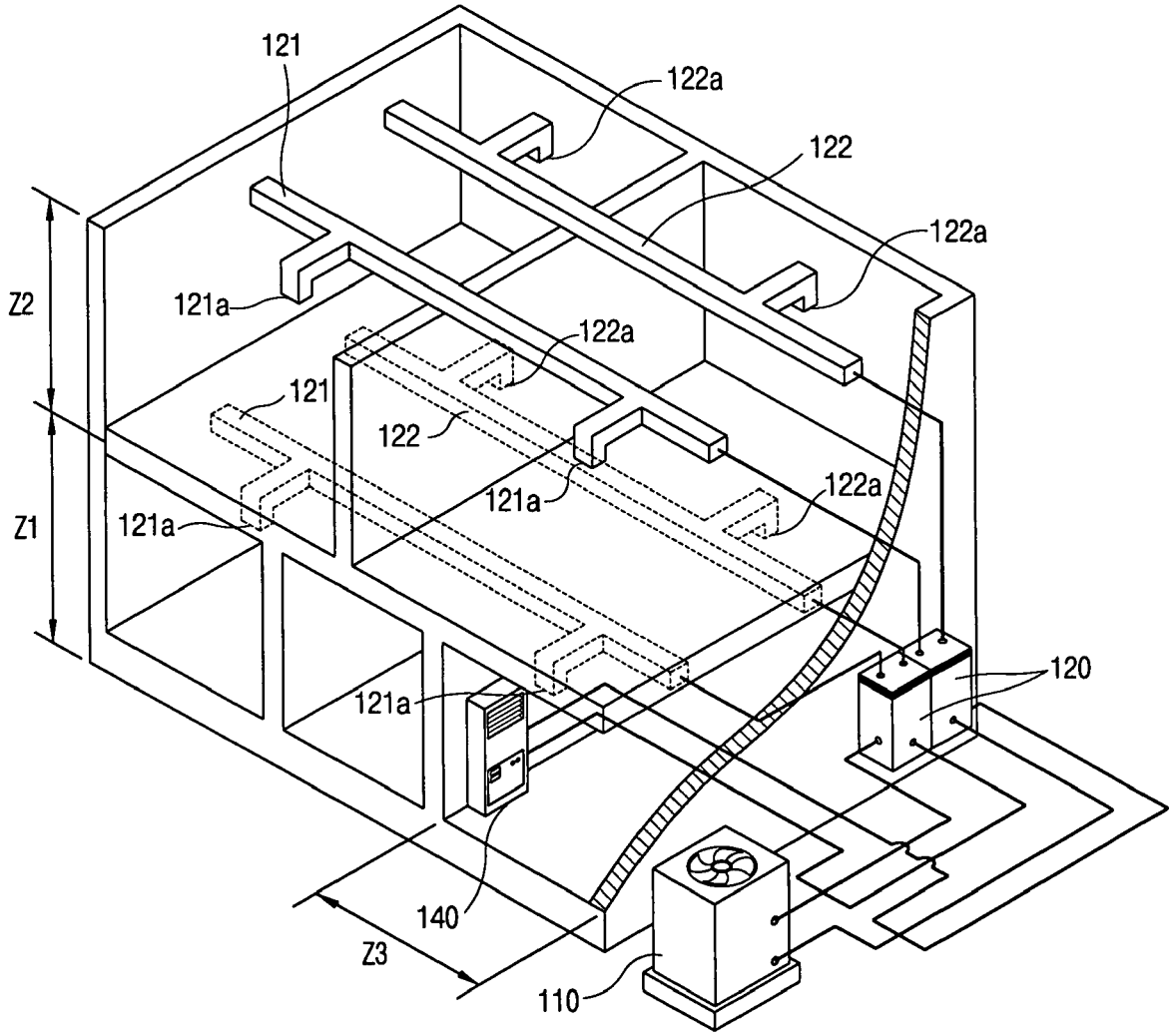
FIG. 3 is a schematic view showing an air conditioning system in accordance with one embodiment of the present invention.
Figure 4:
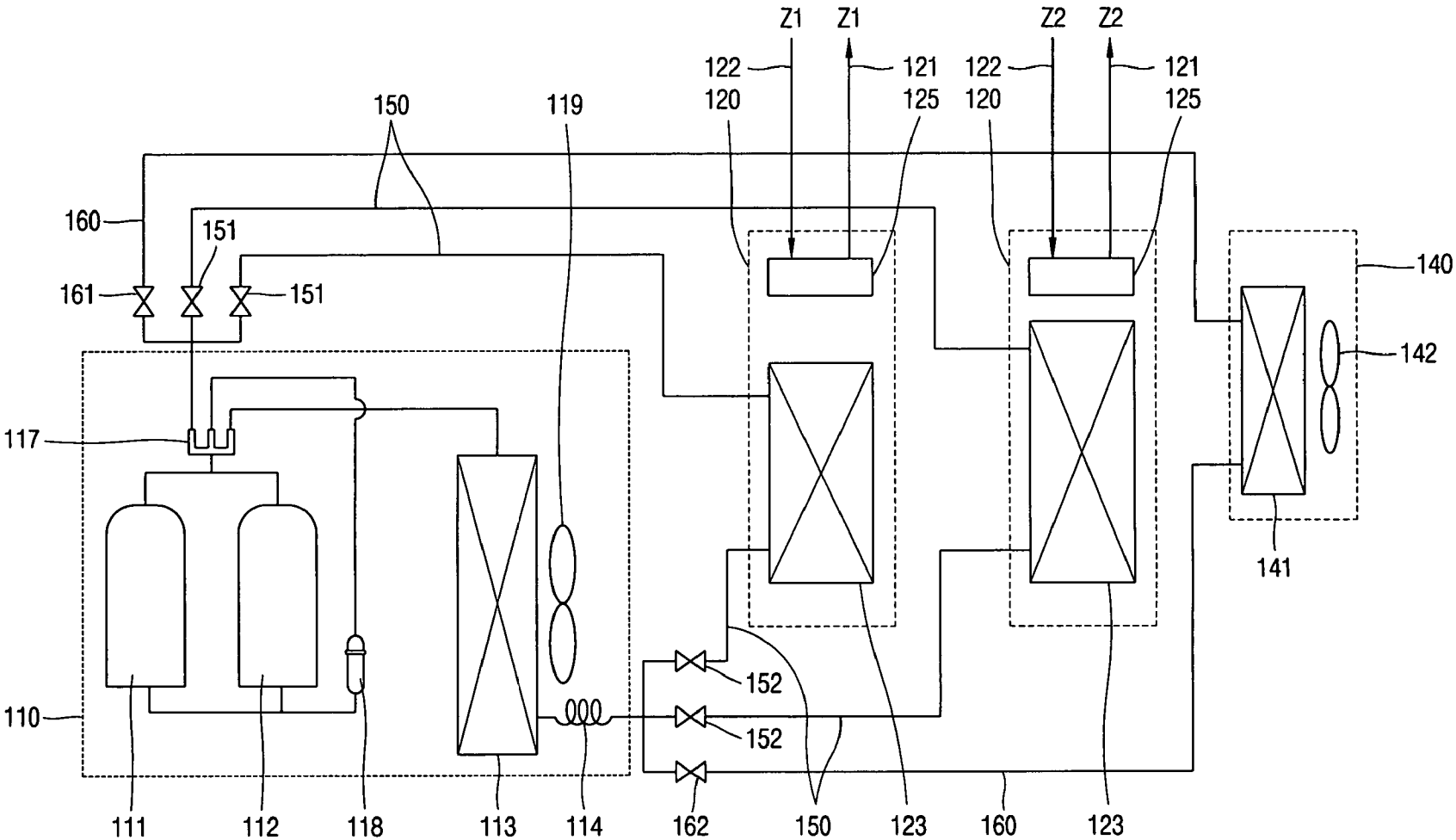
FIG. 4 is a block diagram showing the air conditioning system of FIG. 3.

As shown in FIGS. 3 and 4, a unitary air conditioning system in accordance with an embodiment of the present invention includes an outdoor unit 110 installed outside a building; a plurality of ducts 121 and 122 arranged at each zone (Z1) and (Z2) in the building, for distributing cool or warm air inside the building; at least one central blower unit 120 connected to the outdoor unit 110 and arranged inside or outside the building, for supplying the cool or warm air inside the building through the ducts 121 and 122; and an individual blower unit 140 connected to the outdoor unit 110 and arranged in a specific zone (Z3) of the building, such as a kitchen, for individually supplying the cool or warm air to the specific zone (Z3).

The outdoor unit 110 includes a compressor 111 and 112 for compressing refrigerant; an outdoor heat exchanger 113 for heat exchange between refrigerant and ambient air; a four way valve 117 circulating a refrigerant discharged from the compressor 111 and 112 according to a heating cycle or a cooling cycle; an accumulator 118 disposed in the vicinity of a refrigerant inlet of the compressor 111 and 112, for filtering a liquefied refrigerant; an expander 114 connected to the outdoor heat exchanger 113, for expanding volume refrigerant and reducing pressure of refrigerant; and a fan 119 disposed adjacent to the outdoor heat exchanger 113.

As for the compressor 111 and 112, a single compressor may be used, but a plurality of compressors may be used by being connected in parallel with regard to a size of a building or the like. And in case that a plurality of compressors are used, the compressors operated by different driving methods, such as a variable speed compressor controlled by an invertors and a constant speed compressor are preferably used, thereby reducing power consumption and stably perform the operation. Also, in such case, the two compressors have different compression capacities, so that amounts of the cool and warm air supplied according to operation conditions can be variously controlled.

An orifice pipe can be used as the expander 114, but an electronic expansion valve can be used according to circumstances, wherein the electronic expansion valve can control a flow rate of a refrigerant introduced from the central blower unit 120 and the individual blower unit 140.

The plurality of ducts 121 and 122 are divided thus to be disposed at a plurality of zones (Z1) and (Z2) in the building and are composed of a supply duct 121 having a plurality of discharge openings 121*a*; and a return duct 122 having a plurality of suction openings 122*a*.

Preferably, the number of central blower units 120 corresponds to the number of the zones (Z1) and (Z2), and the central blower units 120 are installed in parallel, so that the cool or warm air can be independently supplied to each zone (Z1) and (Z2). In the present embodiment, a two-story building is divided into a first zone (Z1) on the first story and a second zone (Z2) on the second story, and an air conditioning system in which two central blower units 120 corresponding to the first and second zones (Z1) and (Z2) will be explained.

Each central blower unit 120 includes a first heat exchanger 123 connected to the outdoor unit 110 through a first refrigerant pipe 150; and a blower 125 for supplying the air heat-exchanged by the first heat exchanger 123 to the supply duct 121.

The individual blower unit 140 includes a second heat exchanger 141 connected to the outdoor unit 110 through a second refrigerant pipe 160; and a blower fan 142 for sending air heat-exchanged by the second heat exchanger 141.

The individual blower unit 140 is disposed in a specific zone (third zone (Z3)) having relatively high loads, such as a kitchen or a sun room in the building thus to cool or heat the zone (Z3), individually.

Various types, such as a panel type, a cabinet type, a slim type a ceiling type or the like, can be employed for the individual bower unit 140, and a plurality of individual blower units 140 may be installed to correspond to the number of zones requiring additional cooling or heating.

Meanwhile, the central blower unit 120 and the individual blower unit 140 are respectively connected in parallel with the outdoor unit 110, and valves 151, 152, 161 and 162 for controlling a flow of a refrigerant are installed at the first and second refrigerant pipes 150 and 160 which respectively connect the central blower unit 120 and the individual blower unit 140 with the outdoor unit 110. Accordingly, the operation of the central blower unit 120 and the individual blower unit 140 is controlled by the control of the valves 151, 151, 161 and 162. According to this, cooling or heating operation for each zone in the building is controlled.

Operation of the air conditioning system in accordance with an embodiment of the present invention having such a structure will now be described. Here, a case that the air conditioning system performs a cooling operation will be described as an example.

First, if loads of the first and second zones (Z1) and (Z2) are greater than a preset value, the compressors 111 and 112 are driven to compress a refrigerant, and the compressed refrigerant is introduced into the outdoor heat exchanger 113 through the four way valve 117 thus to be condensed therein. And the condensed refrigerant passes through the expander 114 thus to be expanded, reducing the pressure.

At the same time, when the first refrigerant pipe 150 connecting the central blower unit 120 with the outdoor unit 110 is opened by the operation of the valves 151 and 152, the refrigerant expanded in the expander 114 moves to the first heat exchanger 123, exchanges its heat with ambient air of the first heat exchanger 123 by being evaporated, and then moves toward the outdoor unit 110.

And the air heat-exchanged by the first heat exchanger 123 is forcedly sent by the blower 125, introduced inside the building through the supply duct 121, and discharged to the first and second zones (Z1) and (Z2) through the discharge openings 121*a* of the supply duct 121. And the air having completed its cooling operation in the first and second zones (Z1) and (Z2) is introduced to the return duct 122 through the suction openings 122*a*, is reintroduced into the central blower unit 120, and passes through the first heat exchanger 123 to be cooled again.

Such processes are repeated, thereby performing the central cooling operation on the first and second zones (Z1) and (Z2).

Meanwhile, if the sum of loads of the third zone (Z3) having especially high loads, such as a kitchen or a sun room, is greater than a preset value, the valves 161 and 162 installed at the second refrigerant pipe 160 connecting the individual blower unit 140 with the outdoor unit 110 are opened. Thus, a refrigerant having passed through the outdoor heat exchanger 113 and the expander 114 is introduced to the second heat exchanger 141 of the individual blower unit 140, and exchanges its heat with ambient air of the second heat exchanger 141. And the air heat-exchanged by the second heat exchanger 141 is sent to the third zone (Z3) by the fan 141, thereby individually cooling the third zone (Z3).

Meanwhile, the two compressors 111 and 112 are differentially driven depending on cooling capacities of the central blower unit 120 and the individual blower unit 140, thereby compressing a proper amount of refrigerant. Here, if the sum of cooling loads exceeds 50 percents of the sum of maximum cooling capacities of the central blower unit 120 and the individual blower unit 140, a constant speed compressor is driven and simultaneously, a variable speed compressor 112 is driven so as to correspond to the exceeded cooling load. Therefore, a refrigerant is properly supplied to each blower unit 120 and 140 in operation.

When the air conditioning system in accordance with the present invention performs heating operation, a flow of a refrigerant is converted by operation of the four way valve 117, and a heating cycle is carried out as a reverse cycle of the cooling cycle.

In the unitary air conditioning system in accordance with the present invention, a central blower unit for performing central cooling or heating operation through a duct and an individual blower unit for individually cooling or heating a specific zone where there are relatively high loads are installed to be connected in parallel with one outdoor unit. Accordingly, the cooling or heating operation is carried out zone by zone by using a duct and simultaneously, individual cooling or heating operation can be carried out for a specific zone. Thus, the unitary air conditioning system can advantageously lower a cost and simultaneously, can efficiently perform cooling or heating operation in a building.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A unitary air conditioning system, comprising:

an outdoor unit including a compressor for compressing a refrigerant, an outdoor heat exchanger for heat exchange of the refrigerant, and an expander connected to the outdoor heat exchanger, for expanding the refrigerant;

a duct installed inside a zone of a building;

a central blower unit having a heat exchanger connected to the outdoor unit through a first refrigerant pipe and a blower for supplying the air heat-exchanged by the heat exchanger to the duct; and an individual blower unit including a heat exchanger connected to the outdoor unit through a second refrigerant pipe and a fan for sending the air heat-exchanged by the heat exchanger, and disposed in a specific zone having relatively high loads in the building, for individually cooling or heating the zone.

2. The system of claim 1, wherein valves for controlling a flow of a refrigerant are installed at the first and second refrigerant pipes.

3. A unitary air conditioning system, comprising:

an outdoor unit including a compressor for compressing a refrigerant, an outdoor heat exchanger for heat exchange of the refrigerant, and an expander connected to the outdoor heat exchanger, for expanding the refrigerant;

a duct installed inside a zone of a building;

a central blower unit having a heat exchanger connected to the outdoor unit through a first refrigerant pipe and a blower for supplying the air heat-exchanged by the heat exchanger to the duct; and an individual blower unit including a heat exchanger connected to the outdoor unit through a second refrigerant pipe and a fan for sending the air heat-exchanged by the heat exchanger, and disposed in a zone in the building, for individually cooling or heating the zone, wherein a plurality of central blower units are disposed in parallel.

4. A unitary air conditioning system, comprising:

an outdoor unit including a compressor for compressing a refrigerant, an outdoor heat exchanger for heat exchange of the refrigerant, and an expander connected to the outdoor heat exchanger, for expanding the refrigerant;

a duct installed inside a zone of a building;

a central blower unit having a heat exchanger connected to the outdoor unit through a first refrigerant pipe and a blower for supplying the air heat-exchanged by the heat exchanger to the duct; and an individual blower unit including a heat exchanger connected to the outdoor unit through a second refrigerant pipe and a fan for sending the air heat-exchanged by the heat exchanger, and disposed in a zone in the building, for individually cooling or heating the zone, wherein a plurality of compressors are disposed in the outdoor unit in parallel.

5. The system of claim 4, wherein the plurality of compressors have different capacities.

6. The system of claim 4, wherein the plurality of compressor are driven by different driving methods.

7. The system of claim 3, wherein valves for controlling a flow of a refrigerant are installed at the first and second refrigerant pipes.

8. The system of claim 4, wherein one of the plurality of compressors is a constant speed compressor, and another of the plurality of compressors is a variable speed compressor.

9. The system of claim 4, wherein valves for controlling a flow of a refrigerant are installed at the first and second refrigerant pipes.

* * * * *